United States Patent [19]

Botkins et al.

[11] 4,250,632

[45] Feb. 17, 1981

[54] INLET DUCT FOR RECIRCULATING GRAIN DRYERS

[75] Inventors: Walter Y. Botkins; Jack D. Bussell, both of Overland Park; Nicholas B. Scott, New Strawn; William I. Wood, Waverly, all of Kans.

[73] Assignee: Berico Industries, Inc., Overland Park, Kans.

[21] Appl. No.: 43,117

[22] Filed: May 29, 1979

[51] Int. Cl.[3] ..... F26B 17/12

[52] U.S. Cl. ..... 34/169; 34/65; 34/174; 34/211; 34/212

[58] Field of Search ..... 34/169, 174, 65, 212, 34/211, 223, 225; 432/96, 101

[56] References Cited

U.S. PATENT DOCUMENTS

| | | | |
|---|---|---|---|
| 884,696 | 4/1908 | Wilson | 34/169 |
| 1,669,012 | 5/1928 | Nordstrom | 34/169 |
| 1,926,772 | 9/1933 | Hess | 34/34 |
| 2,701,920 | 2/1955 | Campbell | 34/65 |
| 3,440,734 | 4/1969 | Batterton et al. | 34/174 |
| 3,629,954 | 12/1971 | Lavalier | 34/167 |
| 4,006,536 | 2/1977 | Meiners | 34/169 |
| 4,048,727 | 9/1977 | Botkins | 34/169 |

*Primary Examiner*—Larry I. Schwartz

*Attorney, Agent, or Firm*—Fishburn, Gold and Litman

[57] ABSTRACT

An inlet duct is provided for recirculating grain dryers of the type which have a drying column area, and a recirculating blower mounted in a room portion of the dryer, with an open side of the room communicating with the drying column area. The inlet duct is connected with an intake portion of the recirculating blower, and has an open end thereof disposed adjacent to the open side of the room, whereby during a full recirculating condition of the grain dryer, air is drawn into the recirculating blower substantially wholly from the drying column area. The inlet duct has an aerodynamically streamlined interior shape with walls which taper inwardly toward the blower intake portion for efficiently guiding the flow of air from the drying column area directly into the recirculating blower intake.

6 Claims, 5 Drawing Figures

INLET DUCT FOR RECIRCULATING GRAIN DRYERS

BACKGROUND OF THE INVENTION

The present invention relates to the drying of moisture laden agricultural commodities, and in particular, to an inlet duct for recirculating grain dryers.

In the processing of agricultural commodities, dryers are used to remove moisture from the produce immediately prior to the storage of the same in a silo, elevator, or similar storage structure. Grains such as wheat, corn, rye, and the like, as well as the other commodities such as rice, milo and alphapha are processed in this fashion. These dryers are typically referred to as "grain dryers", and comprise a reservoir which is shaped to retain a variety of commodities therein, and includes at least one large, porous drying portion in which the grain is retained, and through which hot air is blown. The hot air impinges upon the commodity disposed in the porous drying portion, thereby quickly and completely drying the same, and the air is then exhausted directly into the atmosphere. Such dryers are of a single pass design, and inherently require a large quantity of heating energy to adequately dry the grain.

Recirculating grain dryers have been developed to more efficiently dry agricultural commodities by recovering some of the energy in the hot exhaust air, through recirculating at least a portion of the same. The present invention relates to an improvement in a particular type of recirculating grain dryer, such as that disclosed in U.S. Pat. No. 4,048,727 to Botkins, wherein a separate recirculating blower is mounted in a room portion of the dryer, and during the recirculating mode, draws in preheated exhaust air from both the cooling section of the dryer and a lower part of the drying section. The preheated air is further heated, and then blown back into the drying section of the grain dryer. Because the drying air is preheated during the recirculating mode, less energy is required to bring the drying air up to the required temperature, thereby realizing a substantial savings in heating energy.

Although the above referenced type of recirculating grain dryer reduces the consumption of energy necessary to heat the drying air, it does require an additional blower for recirculation, which can increase both manufacturing costs and operating expenses. Hence, the operation of the recirculating blower must be quite efficient to maintain the overall economy of the grain dryer, and further be of a reliable, yet inexpensive design.

Further, in recirculating grain dryers, the exhaust cooling and heating air which is recirculated in the dryer picks up chaff and other debris from the grain as the air is blown through the porous drying portions of the reservoir. This debris is usually a very dry and flammable type of dust, which is blown throughout the dryer during the recirculating mode. Because the recirculating blower must be mounted in or adjacent to the drying column area in which a high concentration of the dust exists, the hazard of fire and/or explosion is increased. This hazard is particularly prevalent in grain dryers having the recirculating blower mounted in a room portion of the dryer, which communicates with the drying column area, such that the air is drawn into the recirculating blower from the room, and the dust collects in the corners and other areas of the room where the air is relatively stagnant.

SUMMARY OF THE INVENTION

The principal objects of the present invention are: to provide an inlet duct for recirculating grain dryers to increase the efficiency of the unit; to provide such an inlet duct which decreases the hazard of fire and explosion during the recirculating mode; to provide such an inlet duct which reduces the cost of the recirculating blower assembly; to provide such an inlet duct which during a full recirculating mode draws preheated air into the recirculating blower substantially wholly from the drying column area to prevent dust build-up in stagnant areas; to provide such an inlet duct with an aerodynamically streamlined interior shape; to provide such an inlet duct which is mounted in a room of the grain dryer with the recirculating blower; to provide such an inlet duct which forms a substantially closed area of the room in which a blower motor is disposed to isolate the same from exposure to debris in the recirculated air; to provide such an inlet duct having an open end thereof extending into the dryer column area for increased efficiency and safety; to provide such an inlet duct with arcuately shaped flashing connected with upper and lower edges of the duct open end for streamlining air flow into the inlet duct; and to provide such an inlet duct which is economical to manufacture, efficient in use, capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis teaching one skilled in the art to variously employ the present invention in virtually any appropriately detailed structure.

Figure 1:
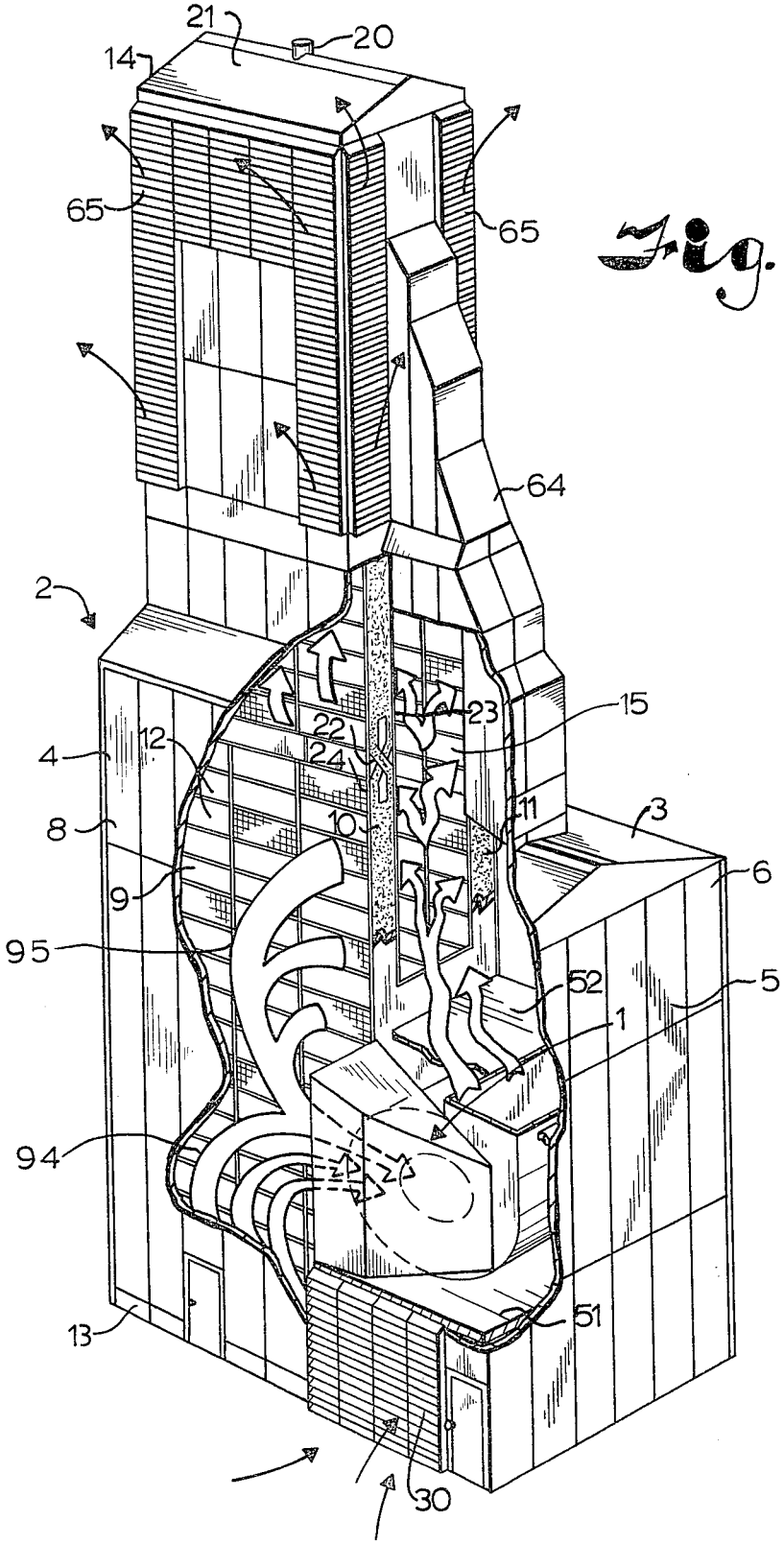
FIG. 1 is a perspective view of an inlet duct embodying the present invention, shown mounted in a grain dryer, with portions thereof broken away.

For purposes of description herein, the terms "upper", "lower", "right", "left", "rear", "front", "vertical", "horizontal", and derivatives thereof shall relate to the invention as oriented in FIG. 1, however, it is to be understood that the invention may assume various alternative orientations, except where expressly specified to the contrary.

The reference numeral 1 generally designates an inlet duct embodying the present invention. The duct 1 is adapted for connection with a recirculating grain dryer of the type which has a drying column area and a recirculating blower mounted in a room portion thereof. The illustrated grain dryer 2 has a building or housing 3 with interconnected side and end walls 4 and 5 respectively. The housing 3 includes a rearward end 6 in which a recirculating blower 7 is disposed, and a forward end 8, which is elevated from the rearward end, and includes the drying column area 9 therein. A pair of vertically oriented columns 10 and 11 are mounted in the forward end 8 of the housing in a parallel and spaced apart relation. The columns 10 and 11 are shaped to retain the grain to be dried therein, and are perforated or porous so as to allow air to be blown or forced therethrough.

Figure 2:
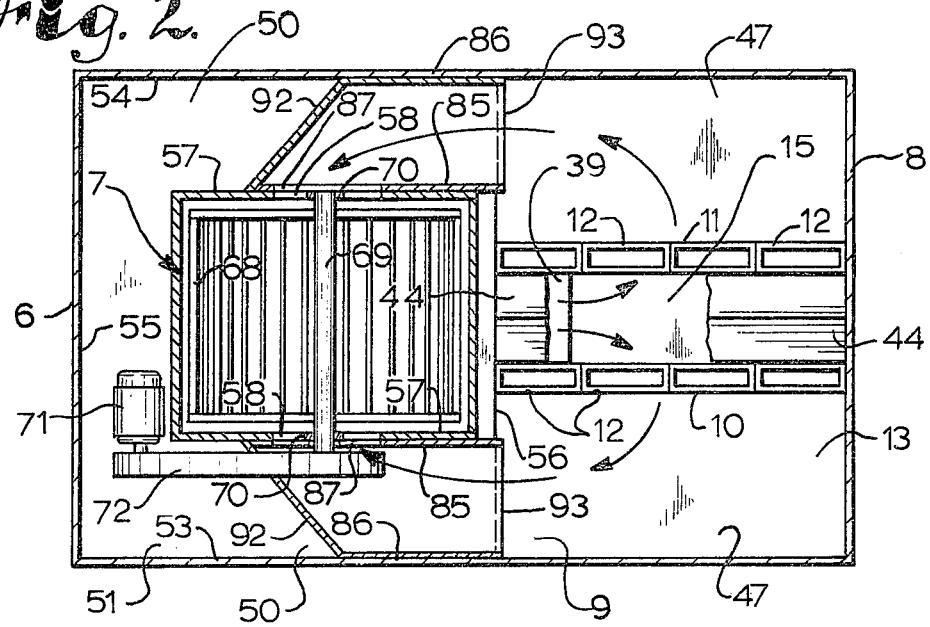
FIG. 2 is a horizontal cross-sectional view of the grain dryer, taken through a medial portion of the inlet duct.

As best shown in FIG. 2, each of the illustrated columns 10 and 11 has four rectangularly shaped sections 12 which are mounted in a end-to-end relation, and are preferably constructed of a woven wire screen with a mesh size which provides maximum open area for air flow, yet securely retains the grain therein. The columns 10 and 11 extend from the base or bottom 13 of the housing to the top 14 thereof, and define an interior column space 15 thereinbetween, for purposes which will be explained hereinafter.

The illustrated grain dryer 2 (FIG. 1) includes a filler spout 20 which extends through the uppermost roof portion 21 of the housing forward end 8, and is connected with the columns 10 and 11 to provide means for introducing or loading the grain into the dryer. Gravitational forces cause the grain to flow downwardly through the columns 10 and 11, and means such as a paddle wheel valve (not shown) are positioned at the lower end of each of the columns to regulate the flow of the grain through the dryer 2. Each of the illustrated columns 10 and 11 includes a flow diverting mechanism 22 adjacent to a medial portion thereof, which diverts the grain from an inside 23 to an outside 24 of the column, and vice a versa, for uniform drying of the grain and increased drying efficiency.

Figure 3:
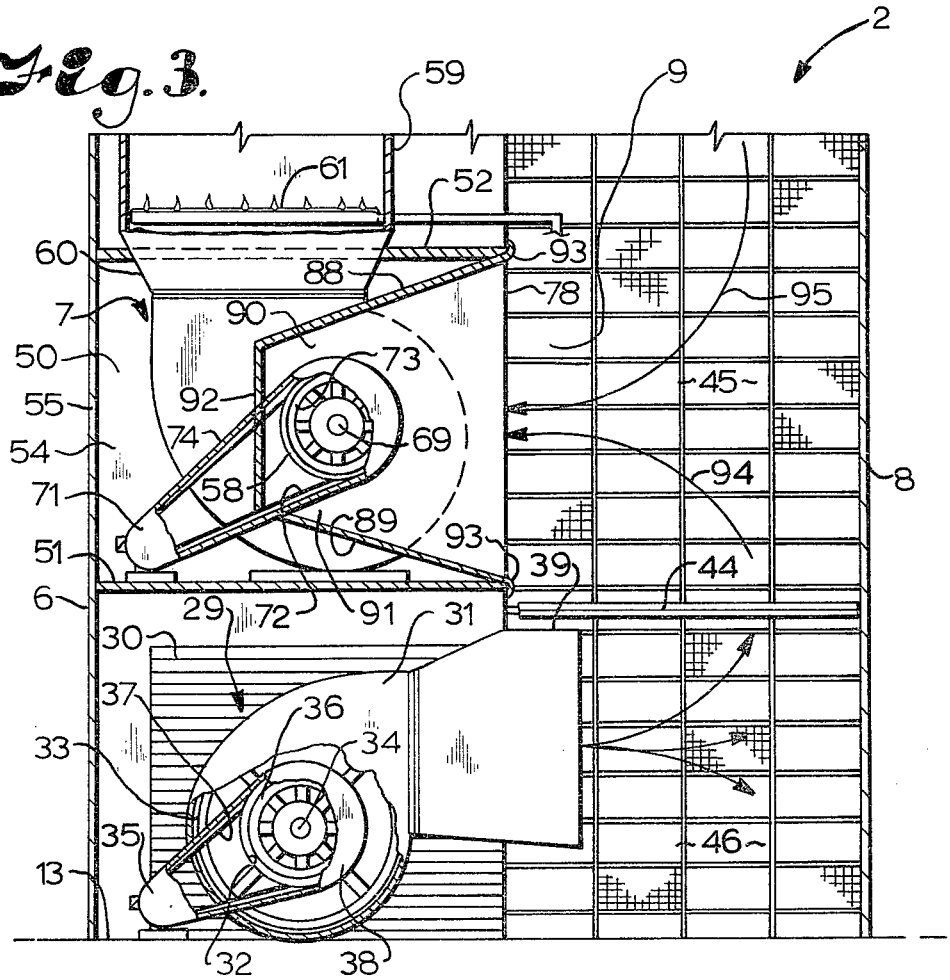
FIG. 3 is a fragmentary, vertical cross-sectional view of the grain dryer, showing intake and recirculating blowers.

As best shown in FIG. 3, the illustrated recirculating grain dryer 2 includes an intake blower 29, which is mounted on the floor 13 of the housing rearward end 6, and draws outside air thereinto through a pair of louvers 30 disposed in the opposing side walls 4 of the housing. In this example, the intake blower 29 is a centrifugal fan, and includes a housing 31 with inlet apertures 32 on each side thereof adjacent an associated one of the louvers 30, and an inner squirrel cage fan blade 33 rotatably mounted on a shaft 34 within the housing 31. The illustrated intake blower 29 is driven by a motor 35 which transmits power thereto by a pulley 36 and belt 37 arrangement. A guard 38 is positioned over the pulley and belt for safety purposes. An outlet duct 39 directs the cool outside air which is drawn through the louvers 30 by the intake blower 29 into the interior column space 15 between the columns 10 and 11 at the lower portion thereof.

The grain dryer 2 preferably includes a damper in the nature of a butterfly valve 44 (FIGS. 2 and 3) rotatably mounted between the two columns 10 and 11, and positioned vertically adjacent to the top of the outlet duct 39 to divide the interior column space 15 into two separate sections. The upper section 45 is a heating portion, and the lower section 46 is a cooling portion. The valve 44 may be manipulated to control the intermixing of air between the heating and cooling sections 45 and 46, to accurately regulate the grain drying process. Further, the valve 44 directs the cool air which is blown into the cooling section 46 by the intake blower 29 outwardly through the lower portions of the columns 10 and 11 into outer exhaust cavities or ducts 47, which are formed between the outside surfaces of the columns 10 and 11 and the inside surfaces of the building sidewalls 4. The exhaust ducts 47 are disposed on opposing sides of the grain dryer, and extend from the bottom to the top of the columns.

Figure 4:
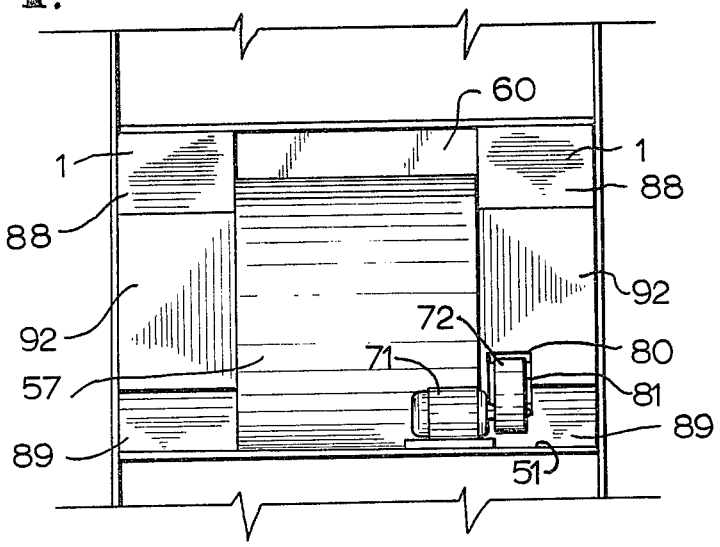
FIG. 4 is a rear elevational view of the recirculating blower with inlet ducts attached thereto.
Figure 5:
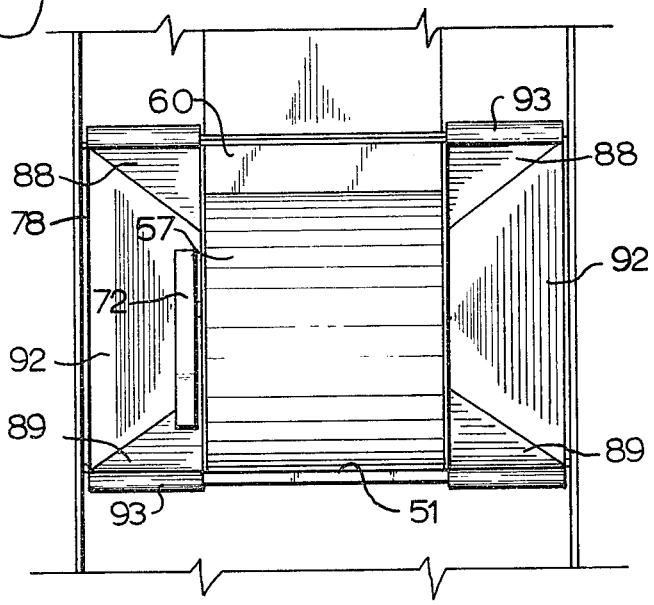
FIG. 5 is a front elevational view of the recirculating blower with inlet ducts attached thereto.

The recirculating blower 7 (FIGS. 2 and 3) is mounted in a room portion 50 of the grain dryer, which is disposed directly above the intake blower 29 in the rearward end 6 of the housing. The room portion 50 includes a floor 51, a ceiling 52, opposed sidewalls 53 and 54, a rear wall 55, and an open side 56 which communicates with and is oriented toward the drying column area 9. The recirculating blower 7 is a centrifugal fan type of blower having a generally arcuately shaped housing 57 (FIG. 4), with intake apertures 58 (FIGS. 2 and 3) at a medial portion of each housing side, and an outlet duct 59 which extends through the ceiling 52 of the room portion 50 and is slightly enlarged from the blower exit 60. Heating means, such as the illustrated gas burner 61 are located in the outlet duct 59 of the recirculating blower to heat the air carried therethrough.

The outlet duct 59 is connected with a vertically oriented distribution duct 64 (FIG. 1), which directs the air blown from the recirculating blower 7 and heated by the burner 61 into the heating section of the interior column space 15, above the butterfly valve 44. The heated air is thereby blown outwardly through the columns 10 and 11, and the grain therein, and is exhausted into the exhaust ducts 47 provided on the exterior sides of the columns. Louvers 65 are provided in the upper portion of the housing walls to vent the air in the exhaust ducts 47 to the atmosphere. The illustrated distribution duct 64 is inclined inwardly in a stepped fashion from the bottom to the top thereof to act as a baffle for evenly distributing the heated air between the columns 9 and 10.

The recirculating blower 7 (FIGS. 2 and 3) has a squirrel cage fan blade 68 mounted in the housing 57 on a shaft 69 with bearings or pillow blocks 70 located at each end thereof. The illustrated recirculating blower is powered by a motor 71, which is preferably electric, and is mounted in the room portion 50 rearwardly of the blower housing 57. A drive belt 72 and pulley 73 are provided to transmit power from the motor 71 to the blower fan, and a safety guard 74 covers the belt 72.

An inlet duct 1 is connected with each side of the recirculating blower 7 and extends from the drying column area 9 to the intake portion 58 of the recirculating blower. The inlet ducts 1 have an open end 78 thereof disposed adjacent to the open side 56 of the room portion 50, whereby during a full recirculating condition of the grain dryer 2, air is drawn into the recirculating blower 7 not from the room 50, but substantially wholly from the drying column area 9, thereby alleviating the build-up of dust in stagnant areas of the room. The inlet ducts 1 have an aerodynamically streamlined interior shape with walls which taper convergingly inwardly from the inlet duct open end 78 to the recirculating blower intake portion 58 for efficiently guiding the flow of air from the drying column area 9 into the recirculating blower intake 58 during recirculation. In the illustrated structure, each of the intake duct open ends 78 extends vertically from the floor 51 to the ceiling 52 of the room 50, and horizontally from an associated side wall 4 to the recirculating blower 7, thereby forming a substantially closed, dust free area 79 disposed rearwardly of the recirculating blower. The drive motor 71 for the recirculating blower is mounted in the closed area 79, thereby isolating the same from exposure to debris in the recirculating air, so as to provide improved operational safety. The drive belt 72 extends through an aperture 80 in the rear panel of the inlet duct, and a removable plate 81 (FIG. 4) may be provided to seal the aperture 80. Further, resilient seals may be provided at the intersection of each side of the belt 72 with the associated inlet duct 1.

The illustrated inlet ducts 1 each include inner and outer side wall panels 85 and 86 respectively which are oriented in a substantially parallel relationship in the longitudinal direction of the grain dryer. The inner panel 85 is positioned adjacent to the side wall of the recirculating blower housing 57 and includes an aperture 87 therethrough which mates with the inlet aperture 58. The outer panel 86 is positioned abutting the sidewall 4 of the housing 3. The ducts 1 also include top and bottom panels 88 and 89 which are interconnected with the inner and outer panels 85 and 86. The top panel 88 extends from the room ceiling 52 downwardly to an upper portion 90 of the recirculating blower intake 58, and the bottom panel 89 extends from the room floor 51 upwardly to a lower portion 91 of the blower intake. The top and bottom panels 88 and 89 are flat and converge inwardly from the inlet duct open end 78 to the recirculating blower intake portion 58 to form a streamlined design for efficient air flow therethrough. A rear panel 92 is connected between the outer panel 86 and the inner panel 85 at an angle in a downstream direction thereto, whereby the duct interior shape tapers inwardly toward the blower intake portion 58. In the illustrated structure, the rear panel 92 has a trapezoidal shape and intersects the inner panel 85 at an angle in the nature of 50° at a point spaced just rearwardly of the rearwardmost portion of the inlet aperture 87. The outer side panel 86 and the duct rear panel 92 intersect at a longitudinally medial portion of the inlet duct. An arcuately shaped deflector or flashing 93 is connected with the upper and lower edges of the inlet duct open end 78, to streamline the air flow into the associated inlet duct 1. The panels of each inlet duct 1 are preferably constructed of a thin, rigid material, such as sheet metal, and are sufficiently strong to withstand high velocity air therethrough. As best illustrated in FIG. 2, the inlet ducts 2 have a width between the inner and outer panels 85 and 86 which is substantially commensurate with that of the exhaust ducts 42, and the same are vertically aligned, such that both the hot and cool exhaust air is efficiently drawn into the recirculating blower 7 through the inlet ducts 1.

Although the illustrated embodiment of the present invention includes outer panels 86 which are separate from the associated housing sidewalls 4, and inner panels 85 which are separate from the associated side portions of the blower housing 57, it is to be understood that the overlapping portions of the inner and outer panels 85 and 86 may be eliminated by encorporating the same into the associated portion of the housing sidewall and blower side, without deviating from the intent of the present invention.

In use, outside air is drawn through the louvers 30 into the intake blower 29, and is expelled therefrom under pressure through the outlet duct 39 into the cooling portion 46 of the interior column space 15. The air is then forced outwardly through the columns 10 and 11 into the associated exhaust ducts 47, thereby cooling the grain in the columns, and raising the temperature of the cooling air. The recirculating blower 7 draws in air through the inlet ducts 1 from the exhaust ducts 47. The air which is drawn into the inlet ducts 1 includes some exhaust cooling air (schematically illustrated by the arrow noted by reference numeral 94), and some exhaust heating air (schematically illustrated by the arrow marked with the reference numeral 95). It is to be noted that both sources of air have passed through at least a portion of one of the drying columns 10 and 11, and have therefore picked up chaff and other debris which is carried into the inlet duct. Since the recirculated air is drawn not from the room portion 50, but substantially wholly from the drying column area 9 via the inlet ducts 1, the hazardous build-up or collection of dust and debris in relatively stagnant areas of the room is alleviated. The aerodynamically streamlined interior shape of the inlet duct walls efficiently guide the flow of air from the exhaust duct directly into the recirculating blower. Because of the arrangement of the inlet ducts 1 in conjunction with the blower housing, the rearward portion of the room 50 is substantially closed and dust free. The drive motor 71 for the recirculating blower is mounted in the isolated area, so as to reduce the hazard of fire and/or explosion of the dust.

It is to be understood that while we have illustrated and described certain forms of our invention, it is not to be limited to the specific forms or arrangement of parts herein described and shown, except insofar as such limitations are included in the following claims.

What is claimed and desired to secure by Letters Patent is:

1. In a recirculating grain dryer having a drying column area, and a recirculating blower mounted in a room with an open side thereof communicating with said drying column area, the improvement comprising:

(a) an inlet duct connected with the recirculating blower and extending from the drying column area to an intake of the recirculating blower; and wherein (b) said inlet duct has an open end thereof disposed adjacent to the open side of the room, whereby during a full recirculating condition of the grain dryer, air is drawn into the recirculating blower substantially wholly from said drying column area;

(c) said room includes a floor, a ceiling, opposed side walls, and a rear wall;

(d) said duct open end extends vertically from the floor of the room to the ceiling of the room, and horizontally from an associated side wall of the room to the recirculating blower, thereby forming a substantially closed, dust-free area of the room disposed rearwardly of the recirculating blower;

(e) said inlet duct has an aerodynamically streamlined interior shape with walls which taper convergingly inwardly from the inlet duct open end to the recirculating blower intake for efficiently guiding the flow of air from the drying column area directly into the recirculating blower intake during recirculation;

(f) said open side is oriented toward said drying column area;

(g) said recirculating blower includes a motor for driving the same;

(h) said motor is mounted in the closed area of the room to isolate the same from exposure to debris in the recirculated air and thereby provide improved safety;

(i) said recirculating blower intake includes an upper portion and a lower portion; and (j) said inlet duct includes;

(1) inner and outer side wall panels oriented in a substantially parallel relationship; said inner and outer duct side wall panels being positioned adjacent to said recirculating blower and an associated one of the room side walls respectively; and (2) top and bottom panels respectively extending from the room ceiling and floor to the upper and lower portions respectively of said recirculating blower intake; said top and bottom panels converging inwardly from the inlet duct open end to the recirculating blower intake for efficient air flow therethrough.

2. A recirculating grain dryer as set forth in claim 1 wherein:

(a) said inlet duct includes a rear panel which extends from the outer to the inner side wall panel of the inlet duct at an angle in a downstream direction thereto, whereby the duct interior shape tapers inwardly toward the blower intake portion.

3. A recirculating grain dryer as set forth in claim 2 wherein:

(a) said outer duct side wall panel and said duct rear panel intersect at a longitudinally medial portion of the inlet duct.

4. In a recirculating grain dryer having a drying column area and a recirculating blower mounted in a room; the room having an open side thereof communicating with the drying column area and a pair of side walls, ceiling and floor; the blower having an intake with upper and lower portions; the improvement comprising:

(a) an inlet duct connected with the recirculating blower and extending from the drying column area to the blower intake;

(b) said inlet duct has an open end thereof disposed adjacent to the open side of the room, whereby during a full recirculating condition of the grain dryer, air is drawn into the recirculating blower substantially wholly from the drying column area;

(c) said inlet duct has inner and outer side wall panels oriented in a substantially parallel relationship; said inner and outer duct side wall panels being positioned adjacent to said recirculating blower and an associated one of the room side walls respectively; and (d) said inlet duct has top and bottom panels respectively extending from the room ceiling and floor to near the upper and lower portions respectively of said recirculating blower intake; said top and bottom panels converging inwardly from the inlet duct open end to the recirculating blower intake portion for efficient air flow therethrough.

5. The recirculating dryer as set forth in claim 4 wherein:

(a) the recirculating blower includes motor means therefor; and (b) said motor means is mounted in a closed area of the room, whereby said motor means is isolated from exposure to debris in air recirculating through the blower so as to provide improved safety.

6. The recirculating dryer as set forth in claim 4 or 5 wherein:

(a) substantially only that portion of the room defined by the inlet duct and the recirculating blower communicates with the drying column area such that a remaining portion of the room is substantially isolated from the drying column area, whereby air recirculated by the blower does not substantially enter said remaining portion of the room.

* * * * *